4/17/84 OR 4,443,736

United States Patent [19]

Chen

[11] 4,443,736

[45] Apr. 17, 1984

[54] ELECTRON GUN FOR DYNAMIC BEAM SHAPE MODULATION

[75] Inventor: Hsing-Yao Chen, Landisville, Pa.

[73] Assignee: RCA Corporation, New York, N.Y.

[21] Appl. No.: 304,784

[22] Filed: Sep. 23, 1981

[51] Int. Cl.[3] ..... H01J 29/51; H01J 29/52

[52] U.S. Cl. ..... 313/414; 313/444; 313/449; 313/460

[58] Field of Search ..... 313/414, 413, 460, 449, 313/444

[56] References Cited

U.S. PATENT DOCUMENTS

| | | | |
|---|---|---|---|
| Re. 25,127 | 2/1962 | Szegho | 313/460 X |
| 2,859,378 | 11/1958 | Gundert et al. | 313/414 X |
| 4,218,634 | 8/1980 | Takenaka | 313/449 X |
| 4,234,814 | 11/1980 | Chen et al. | 313/414 X |
| 4,319,163 | 3/1982 | Chen | 313/414 X |

FOREIGN PATENT DOCUMENTS

| | | | |
|---|---|---|---|
| 56-3949 | 1/1981 | Japan | 313/414 |
| 707064 | 4/1954 | United Kingdom | 313/460 |
| 670991 | 6/1979 | U.S.S.R. | 313/460 |

*Primary Examiner*—Palmer C. Demeo

*Attorney, Agent, or Firm*—Eugene M. Whitacre; Dennis H. Irlbeck

[57] ABSTRACT

In an electron gun that includes a cathode, a control grid, a screen grid and at least two main focus lens electrodes, an improvement comprises the screen grid including a first portion having a circular aperture, a second portion having at least one elongated aperture and a third portion having a circular aperture. The first and third portions are electrically insulated from the second portion.

2 Claims, 4 Drawing Figures

Fig. 1
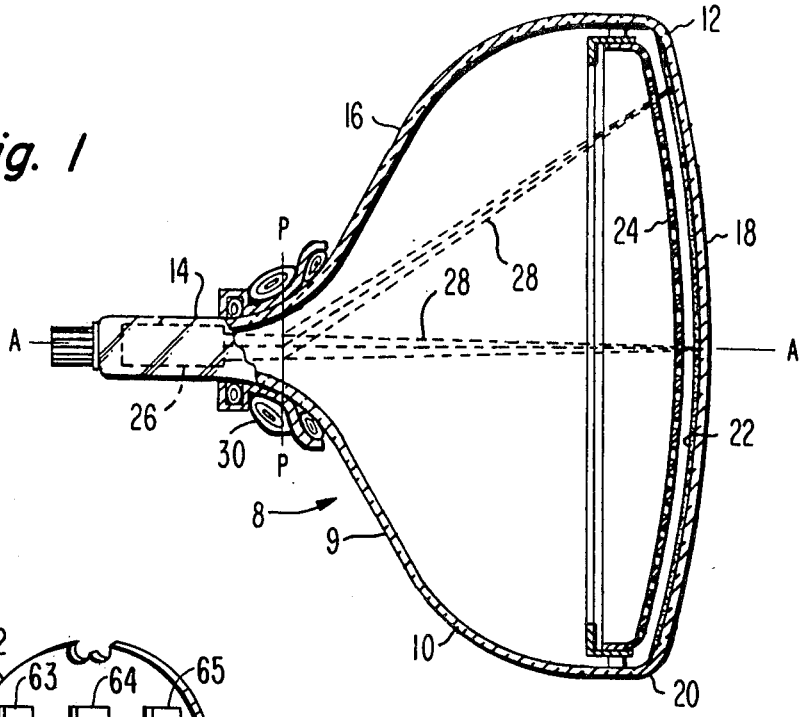
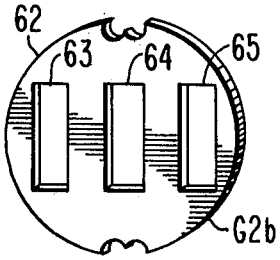
Fig. 4
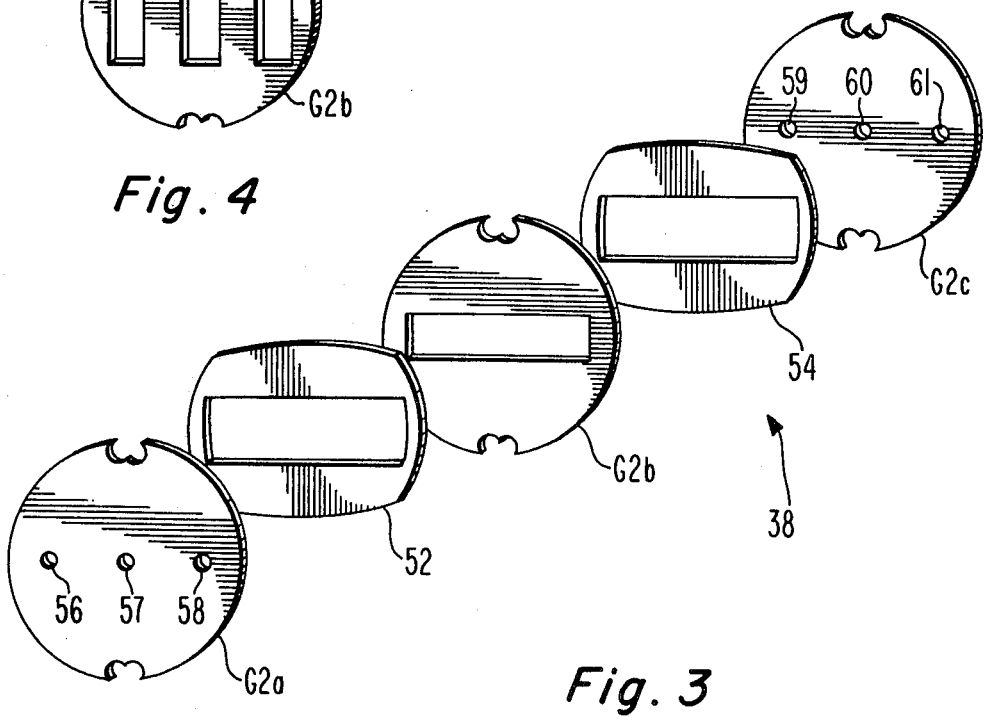
Fig. 3

ELECTRON GUN FOR DYNAMIC BEAM SHAPE MODULATION

BACKGROUND OF THE INVENTION

The present invention relates to electron guns such as those used in color picture tubes, and particularly to an improved electron gun capable of providing dynamic beam shape modulation.

There are several different types of electron guns used in color picture tubes. One type of gun presently in wide use is an inline electron gun. An inline electron gun is designed to generate at least two, and preferably three, electron beams in a common plane and to direct the beams along convergent paths to a small area spot on the screen.

There has been a general trend toward inline color picture tubes with greater deflection angles so as to provide shorter tubes. However, in tubes with 110° deflection, it has been found that the electron beams become excessively distorted as they are scanned toward the outer portions of the screen. Such distortions, commonly referred to as flare, appear on the screen of the tube as an undesirable low intensity tail or smear extending from a desirable intense core or spot. Such flare distortions are due, at least in part, to the effects of the fringe portions of the deflection field of the tube deflection yoke on a beam as it passes through the electron gun, and to the nonuniformities in the yoke deflection field itself.

When the yoke's fringe field extends into the region of the electron gun, as is usually the case, the beams may be deflected slightly off axis and into a more aberrated portion of an electron lens of the gun. The result is frequently a flare distortion of the electron beam spot which extends from the spot toward the center of the screen. This condition is particularly troublesome in tubes having self-converging yokes with a toroidal deflection coil, because of the relatively strong fringing of toroidal type coils.

Self-converging yokes are designed to have a nonuniform field in order to increasingly diverge the beams as the horizontal deflection angle increases. This nonuniformity also causes vertical convergence of the electrons within each individual beam. Thus, the beam spots are vertically overconverged at points horizontally displaced from the center of the screen, causing a vertically extending flare both above and below the beam spot.

The vertical flare due to both the effects of the yoke's fringe field in the region of the gun and to the nonuniform character of the yoke field itself is an undesirable condition which contributes to poor resolution of a displayed image on the screen.

It is known to provide nonsymmetrical electron gun electrodes to provide a desired astigmatism in the electron optics of the gun, to compensate for the above-described flare astigmatism. See, for example, U.S. Pat. No. 4,234,814, issued to Chen and Hughes on Nov. 18, 1980, which describes a screen grid electrode having an aperture of rectangular cross-section facing backward toward the cathode and of circular cross-section facing forward toward the screen. This astigmatic screen grid is of one piece, electrically speaking, and is energized during tube operation with a fixed DC bias voltage. While this gun does reduce flare astigmatism to a degree sufficient for some tubes, still further correction is desirable for other tubes, particularly very wide angle deflection tubes, especially where they are to be used to display printed matter near the corners of the screen.

It also is known to provide a two-part screen grid electrode comprising a first apertured plate having an elongated aperture and a second plate having a circular aperture. Such structure is disclosed in U.S. patent application Ser. No. 164,685, now U.S. Pat. No. 4,319,163, filed on June 30, 1980 for "ELECTRON GUN WITH DEFLECTION-SYNCHRONIZED ASTIGMATIC SCREEN GRID MEANS" by Chen. In operating this gun, the second plate is energized with a DC bias voltage and the first plate is energized with a DC bias voltage superposed with a dynamic signal synchronized with the horizontal and/or vertical deflection signals. One drawback of this design is that, unless the modulation voltage is very small, the brightness of the tube also is modulated by the dynamic voltage applied.

It is therefore desirable to develop an electron gun design that utilizes a dynamic voltage to reduce the problem of flare but does not permit brightness modulation as a result of the application of the dynamic voltage.

SUMMARY OF THE INVENTION

In an electron gun that includes a cathode, a control grid, a screen grid and at least two main focus lens electrodes, an improvement comprises the screen grid including a first portion having a circular aperture, a second portion having at least one elongated aperture and a third portion having a circular aperture. The first and third portions are electrically insulated from the second portion.

BRIEF DESCRIPTION OF THE DRAWINGS

FIG. 1 is a plan view, partly in axial section, of a color picture tube embodying the invention.

FIG. 3 is an exploded view in perspective of the elements of the screen grid electrode of the gun of FIG. 2.

FIG. 4 is a perspective view of an alternate G2*b* electrode.

DETAILED DESCRIPTION OF THE PREFERRED EMBODIMENTS

Figure 2:
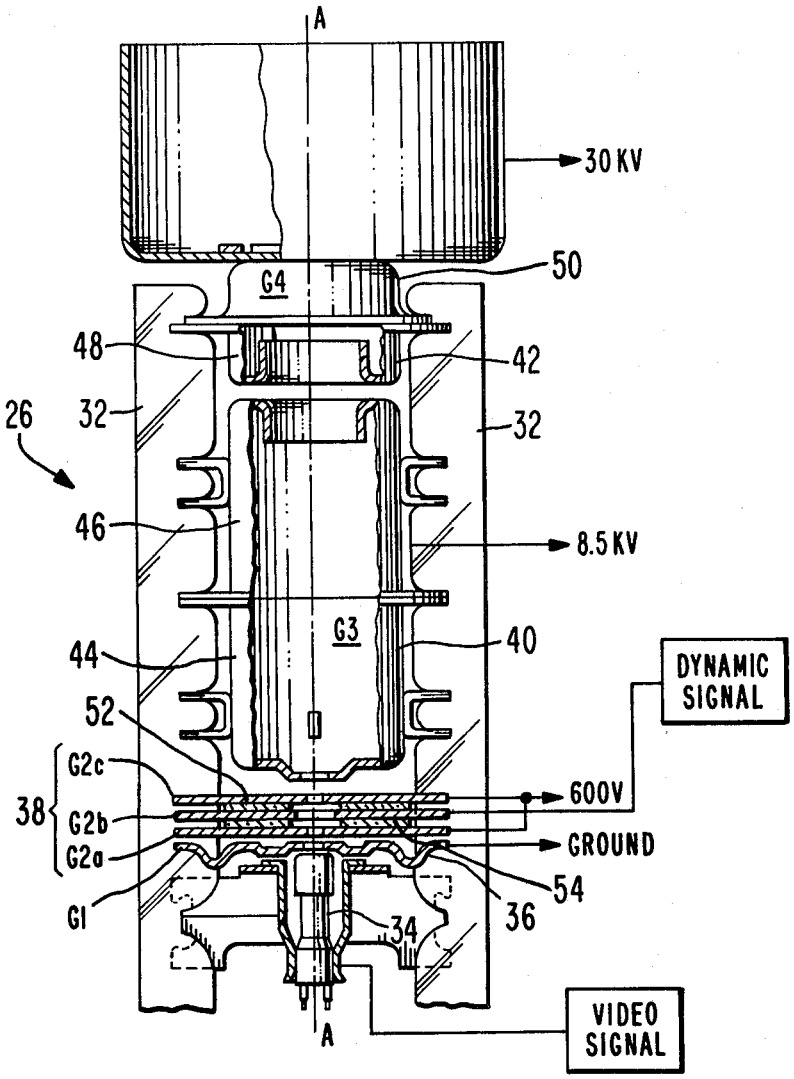
FIG. 2 is a partial axial section view of the electron gun shown in dashed lines in FIG. 1.

FIG. 1 shows a color picture tube 9 having a glass envelope 10, comprising a rectangular faceplate panel or cap 12 and a tubular neck 14 connected by a rectangular funnel 16. The panel 12 comprises a viewing faceplate 18 and a peripheral flange or sidewall 20 which is sealed to the funnel 16. A mosaic three-color phosphor screen 22 is carried by the inner surface of the faceplate 18. The screen 22 is preferably a line screen with the phosphor lines extending substantially perpendicular to the high frequency raster line scan of the tube (i.e., normal to the plane of FIG. 1). A multiapertured color selection electrode or shadow mask 24 is removably mounted, by known means, in predetermined spaced relation to the screen 22. An improved inline electron gun 26, shown schematically by dashed lines in FIG. 1, is centrally mounted within the neck 14 to generate and direct three electron beams 28 along coplanar convergent paths through the mask 24 to the screen 22.

The tube 9 of FIG. 1 is designed to be used with an external magnetic deflection yoke, such as the yoke 30 schematically shown surrounding the neck 14 and funnel 16 in the neighborhood of their junction. When activated, the yoke 30 subjects the three beams 28 to vertical and horizontal magnetic fields which cause the beams to scan horizontally and vertically, respectively, in a rectangular raster over the screen 22. The initial plane of deflection (at zero deflection) is shown by the line P—P in FIG. 1 at about the middle of the yoke 30. Because of fringe fields, the zone of deflection of the tube extends axially, from the yoke 30 into the region of the gun 26. For simplicity, the actual curvature of the deflected beam paths in the deflection zone is not shown in FIG. 1. A preferable magnetic deflection yoke 30 is a saddle-toroid type (ST yoke), such as described in U.S. Pat. No. 4,143,345, issued to Barkow on Mar. 6, 1979.

Except for the modifications described below, the electron gun 26 may be of the three beam inline type similar to those described in the above-cited copending U.S. application Ser. No. 164,685 and U.S. Pat. No. 4,234,814. Both the patent and application disclose modified versions of the electron gun described in U.S. Pat. No. 3,772,554, issued to Hughes on Nov. 13, 1973, all three of which are incorporated by reference herein for purpose of disclosure.

Details of the electron gun 26 are shown in FIGS. 2 and 3. The gun comprises two glass support rods 32 on which the various electrodes are mounted. These electrodes include three equally spaced inline cathodes 34 (one for each beam and only one of which is shown), a control grid electrode 36 (G1), an improved screen grid 38 (G2*a*, G2*b* and G2*c*), according to the invention, a first main focus lens electrode 40 (G3), and a second main focus lens electrode 42 (G4), spaced along the glass rods 32 in the order named. Each of the G1, the G4 and both ends of the G3 electrodes has three inline apertures therein to permit passage of three coplanar electron beams. The construction of the screen grid 38 is described below. The main electrostatic focusing lens in the gun 26 is formed between the G3 electrode 40 and the G4 electrode 42. The G3 electrode 40 is formed with two cup-shaped elements 44 and 46, the open ends of which are attached to each other. Although the G3 electrode 40 is shown as a two-piece structure, it could be fabricated from any number of elements, including a single element of the same length. The G4 electrode 42 also is formed by two cup-shaped elements, 48 and 50, attached together at their open ends. Furthermore, although the main focus lens in shown as being formed by two electrodes, it could be formed by three, four or more electrodes (in which case the voltages applied would be different than shown).

The portion of the electron gun 26 comprising the cathodes 34, the control grid electrode 36 and the screen grid means 38 is known as the beam forming region of the gun. The beam forming region generates electrons and forms them into beams having crossovers in the vicinity of the screen grid 38. The main focus lens electrodes 40 and 42 comprise the beam focusing region of the gun. The beam focusing region establishes an electrostatic focusing field for focusing the electron beams to image the crossovers on the screen.

The improved screen grid 38 includes three active portions, comprising stacked apertured metal plates G2*a*, G2*b* and G2*c*, separated by two insulating portions comprising ceramic spacers 52 and 54. The outside plates G2*a* and G2*c* are similar, having three inline apertures 56, 57 and 58 and 59, 60 and 61, respectively. The center plate G2*b* has one large elongated aperture, which preferably extends beyond the outer edges of the outer two apertures 56 and 58, and 59 and 61 in the G2*a* and G2*c* plates, respectively.

The G2*a* and G2*c* plates are electrically connected and have a DC bias voltage applied to them to control beam cutoff. The G2*b* plate has a vertical and horizontal deflection related composite dynamic signal superposed on a DC voltage applied to it. This dynamic signal modulates the beam cross section shape according to the deflection, thereby compensating for the above-mentioned flare. This dynamic signal may be similar to that disclosed in the above-cited copending U.S. application Ser. No. 164,685.

The dynamic modulation voltage electrically varies the slot lens strength of the G2*b* plate, and hence improves the corner resolution without sacrificing the center resolution. Meanwhile, the outside plate G2*a* shields the dynamic signal from the area of the G1 grid and thus help to minimize the brightness modulation of the tube.

Some typical dimensions for the electron gun 26 of FIG. 2 are presented in the following table.

TABLE

| | |
|---|---|
| External diameter of tube neck | 29.00 mm |
| Internal diameter of tube neck | 24.00 mm |
| G2a, G2b and G2c thicknesses | 0.127 mm |
| Spacers 52 and 54 thicknesses | 0.152 mm |

In tests performed with an electron gun constructed in accordance with the present invention, a reduction of 30 percent in electron beam flare was noted at the corners in a 63 cm diagonal, 110° deflection color picture tube.

FIG. 4 shows another embodiment of the G2*b* electrode, wherein the G2*b* electrode 62 has three vertical slots, 63, 64 and 65, instead of a single horizontal slot as shown in FIG. 3 and described above. However, similar beam shaping can be obtained from the G2*b* electrode 62 by reversing the polarity of the dynamic voltage from that applied to the G2*b* electrode with the single horizontal slot.

What is claimed is :

1. In a three inline beam electron gun including three inline cathodes, a control grid having three inline apertures, a screen grid and at least two main focus lens electrodes, the improvement comprising said screen grid including three stacked apertured metal plates separated from each other by two electrically insulating members, the two outside plates having three inline apertures and the center plate having at least one elongated aperture effectively extending at least to the outer edges of the two outer apertures of the outside plates.

2. The electron gun as defined in claim 1 wherein said two outside plates are electrically connected.

* * * * *